United States Patent [19]

Biffle

[11] 3,965,987

[45] June 29, 1976

[54] METHOD OF SEALING THE ANNULUS BETWEEN A TOOLSTRING AND CASING HEAD

[75] Inventor: Morris S. Biffle, Odessa, Tex.

[73] Assignee: Dresser Industries, Inc., Dallas, Tex.

[22] Filed: Dec. 19, 1974

[21] Appl. No.: 534,497

Related U.S. Application Data

[62] Division of Ser. No. 339,037, March 8, 1973, Pat. No. 3,868,832.

[52] U.S. Cl. ..... 166/315; 166/84; 277/31

[51] Int. Cl.[2] ..... E21B 23/00; E21B 33/03

[58] Field of Search ..... 166/315, 82, 84; 175/84; 64/23.5; 277/31

[56] References Cited

UNITED STATES PATENTS

| | | | |
|---|---|---|---|
| 2,222,082 | 11/1940 | Leman et al. | 64/23.5 |
| 2,673,615 | 3/1954 | Humason | 166/84 |
| 3,023,012 | 2/1962 | Wilde | 277/31 |
| 3,052,300 | 9/1962 | Hampton | 166/84 |
| 3,724,862 | 4/1973 | Biffle | 277/31 |

*Primary Examiner*—James A. Leppink
*Attorney, Agent, or Firm*—Marcus L. Bates

[57] ABSTRACT

Method of going into and coming out of a cased borehole with a toolstring of varying outside diameter wherein the annulus formed between the toolstring and the borehole wall near the casing head must be sealed against fluid flow.

The method is carried out by locating a rotatable stripper rubber to the casing head and arranging a second rotatable stripper rubber in spaced superimposed relationship above the first rubber, with the first rubber being larger than the second so as to enable different size tubular goods associated with a drill string to be withdrawn from the borehole, with one of the strippers always sealingly engaging a marginal length of the drill string. Accordingly, the apparatus provides a method of controlling the well pressure during borehole forming operations.

Each of the strippers are removably affixed to a rotating sleeve by a quick disconnect means in the form of a circumferentially extending hinged clamp means.

10 Claims, 13 Drawing Figures

METHOD OF SEALING THE ANNULUS BETWEEN A TOOLSTRING AND CASING HEAD

REFERENCE TO RELATED PATENT APPLICATIONS

U.S. Pat. application Ser. No. 339,037 filed Mar. 8, 1973; now U.S. Pat. No. 3,868,832; of which this patent application is a Divisional.

BACKGROUND OF THE INVENTION

During borehole forming and borehole repair operations, where substantial bottomhole pressures are encountered, and sometimes in various operations associated with the completion of hydrocarbon producing wells, it is necessary to rotate the tool string, tubing string, or drill pipe string while the string is being lowered into or withdrawn from the well bore. This expedient is attained by the provision of a rotating seal member, referred to herein and in the prior art as a stripper rubber, with the stripper being rotatably positioned near the well head in sealed relationship respective of the drill string going into or out of the borehole.

In order to prevent excessive wear of the stripper, it is necessary that the stripper rotate with the piping so that the only significant wear encountered is in the longitudinal movement of the piping relative to the stripper.

In my prior U.S. Pat. No. 3,724,862 to which reference is made for further background of the present invention as well as many additional details of its operation, there is disclosed a blow-out preventer of the rotating type, hereinafter throughout this disclosure referred to as a "BOP of the rotating type", or in some instances, merely a RBOP (rotating blow-out preventer).

Throughout this disclosure, the term tubing string or piping refers to a drill string, including the various tools attached thereto, such as a stabilizer, a drill collar, as well as the kelly, and further includes other tubular goods such as production tubing, instrument packages, jars, fishing tools, and the like. The drill or tool string is generally circular or round in configuration, except for the kelly which usually is noncircular in configuration. Hence, the stripper rubber must deform sufficiently to sealingly engage of outer peripheral surface of each of these recited members.

In the various prior art rotary drilling head assemblies, or RBOP, the stripper is usually affixed to a lower marginal portion of the rotating sleeve, thereby rendering replacement or repair extremely difficult when the head is operatively affixed to the upper terminal end of the well bore.

In my previously referred to issued patent, the rotating stripper is affixed to the upper terminal end of the rotating sleeve by means of the mounting plate bolted onto structure associated with the sleeve. Substitution of one stripper for another must sometimes be carried out several times each trip the tool string makes into the borehole, and accordingly, it is desirable to be able to rapidly renew the stripper, or to substitute one size stripper for another. Moreover, it is desirable to provide a reliable seal means at the interface formed between the fixed and rotating sleeves and to protect the bearing surfaces which rotatably secure the rotating sleeve from up or downhole thrust by the provision of improvements in the seal and lubrication system therefor. It is also desirable to have provisions by which two divergent sizes of tubing string can be sealingly run uphole and downhole through the RBOP without resorting to other means of sealing the upper annulus between the tool string and the wall of the well bore.

SUMMARY OF THE INVENTION

This invention relates to and specifically claims a method for sealing the upper annulus formed between a borehole wall and a drill string so as to control the pressure within the upper borehole annulus. The apparatus is comprised of a RBOP assembly having a seal assembly supported by a stationary housing, with the seal assembly comprising a rotatable sleeve member journaled to a stationary housing, with a stripper being removably mounted to the rotatable sleeve member in a new and improved manner. The interface between the rotatable sleeve and the housing has a seal therebetween which is protected by a pressurized lubrication system.

In one form of the apparatus, spaced axially aligned strippers of different inside diameters (i.d.'s) are removably mounted to the rotating sleeve so as to enable different sizes of series connected components of the tool string to sealingly pass therethrough, with one of the strippers always sealingly engaging an outermost marginal length of the tool string.

The method of the present invention is carried out by attaching the spaced axially aligned strippers at the upper extremity of the borehole with the upper stripper being smaller in diameter than the lower stripper so that the upper stripper normally sealingly engages the outer peripheral wall surface of the tubing string until the tubing string enlarges in outside diameter (o.d.) to a value which precludes its being received within the small i.d. stripper, whereupon the enlargement is pulled into sealing engagement with the lower and larger stripper, the upper and smaller stripper than is removed from the BOP, thereby enabling the drilling operation to continue with the string being disposed in sealing engagement with the larger and lowermost stripper assembly.

Accordingly, a primary object of the present invention is the provision of improvements in RBOP's which are more efficient in operation, and which have longer life due to improved characteristics of wear and sealing.

Another object of the invention is to provide improvements in rotary drilling heads by the provision of a removable stripper which is held in operative relationship by a clamp means.

A further object of this invention is to provide improvements in a pressure lubrication system for maintaining the seal components of a BOP isolated from foreign debris including drilling mud.

A still further object of this invention is to provide a rotating BOP having dual strippers therein which sealingly accommodate different size components associated with a drill string.

Another and still further object is to provide an improved method of controlling the pressure in the borehole annulus where high bottomhole pressures are encountered.

An additional object of this invention is to provide an improved method of carrying out a drilling operation wherein tubular goods of varying diameters must be run into and out of the borehole.

Another object of the invention is to provide a method of going into and coming out of a borehole with a tool string of varying o.d., wherein the annulus between the tool string and the borehole wall must be sealed against fluid flow.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
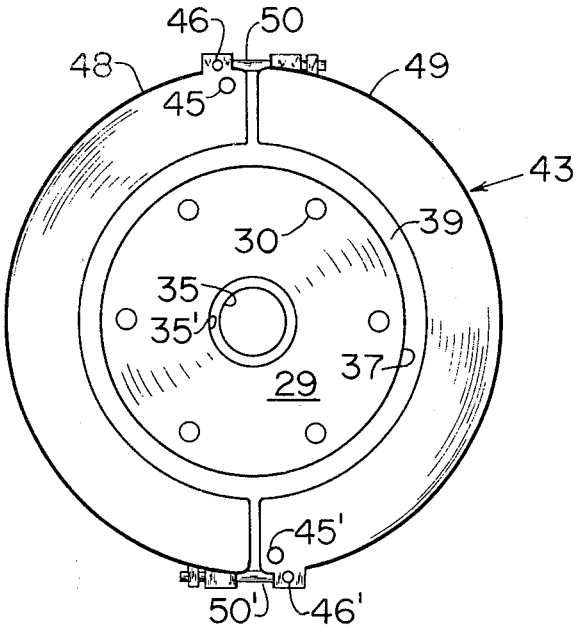
FIG. 1 is a top plan view of a rotating BOP made in accordance with the present invention.
Figure 2:
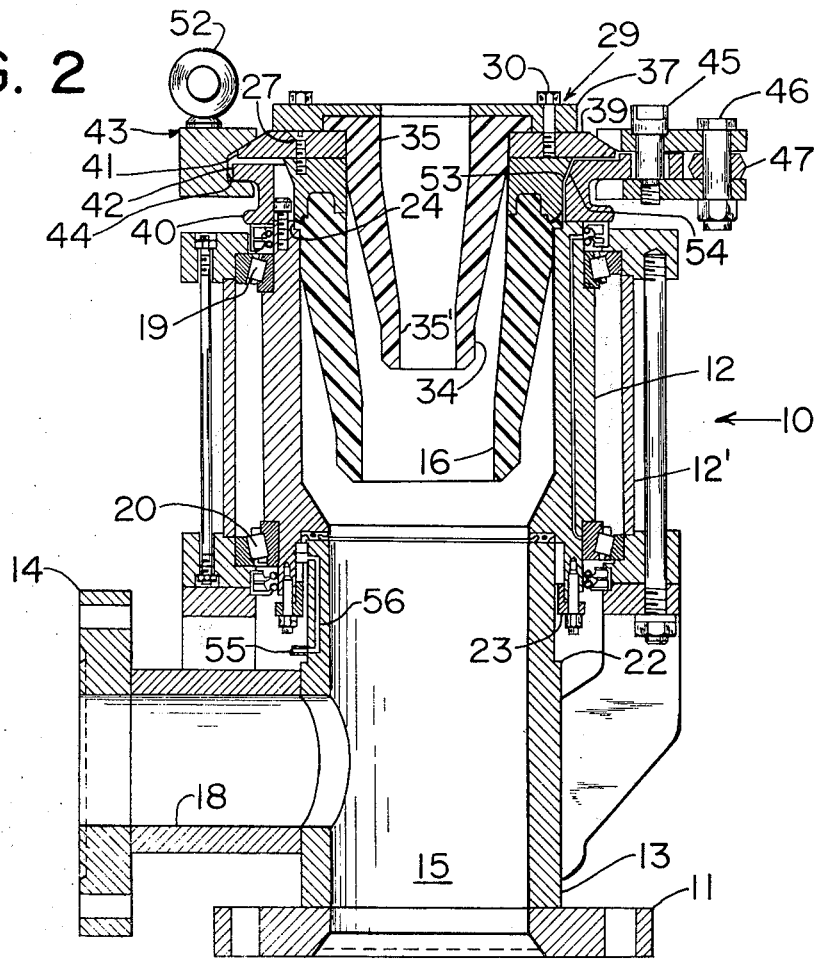
FIG. 2 is a longitudinal, cross-sectional, side view of the rotating BOP disclosed in FIG. 1, with some additional parts being included to add clarity to the drawing.
Figure 3:
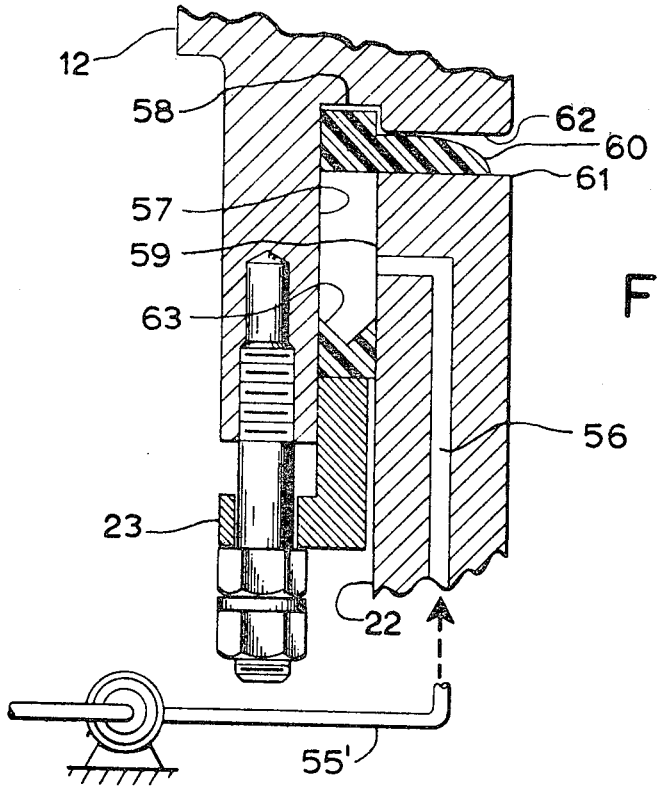
FIG. 3 is an enlarged, fragmentary, cross-sectional view of part of the apparatus disclosed in FIGS. 1 and 2, with some parts not being shown in sections, and other additional parts being diagrammatically illustrated.
Figure 4:
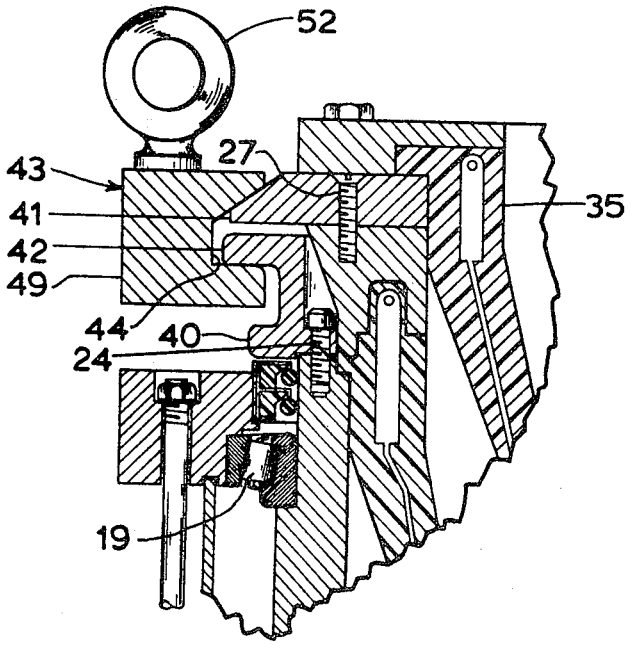
FIG. 4 is a fragmentary, enlarged, cross-sectional view of part of the apparatus disclosed in FIGS. 1 and 2.
Figure 5:
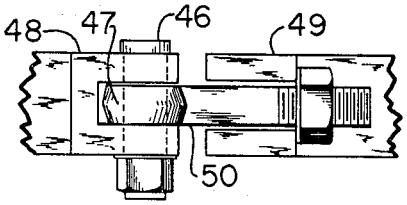
FIG. 5 is a fragmentary, enlarged, detailed side elevational view of part of a clamp apparatus disclosed in FIGS. 1 and 2.
Figure 6:
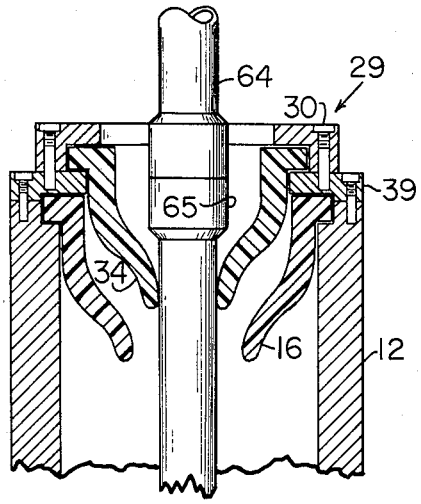
FIGS. 6–10 are part schematical, part diagrammatical, part cross-sectional, broken side views of apparatus used in carrying out the method of the present invention; and, FIGS. 11–13 are longitudinal cross-sectional views of apparatus made in accordance with another embodiment of the present invention.
Figure 7:
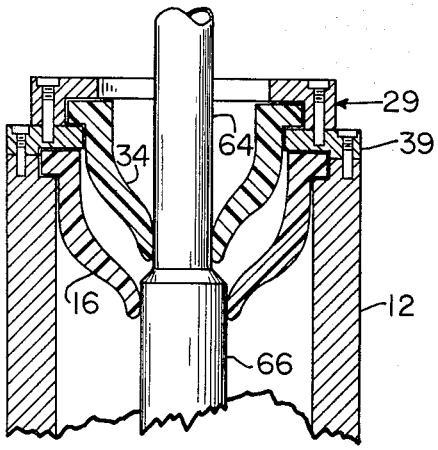
Figure 8:
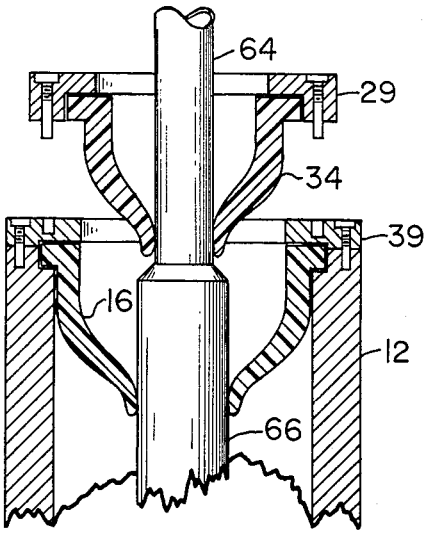

In FIGS. 1 and 2 of the drawings, in conjunction with FIGS. 3 – 5, there is disclosed a rotating BOP generally indicated by the arrow at numeral 10. The RBOP is comprised of a stationary housing 13 which is bottom supported from a flange 11, and which rotatably supports a rotatable sleeve member 12 spaced from a fixed sleeve number 12'. Outlet flange 14 can be connected to a mud pit flow line (not shown). Inlet 15 is axially aligned with a large stripper 16. The stripper is removably affixed to the rotatable sleeve member and moves therewith so that flow from inlet 15 is diverted by the stripper through the outlet 18 and into the mud pit flow line.

Load bearing spaced tapered roller bearings 19 and 20 prevent thrust of the stripper assembly uphole or downhole and for this reason the bearings must be able to withstand a load proportional to the anticipated pressures which may be encountered within the borehole annulus.

A marginal length of the stationary skirt is polished at 22 so as to present low friction with respect to the illustrated spaced hydraulic seal means. The annular rotating seal backing plate 23 captures the seal therein as will be described in greater detail later on.

As best illustrated in FIG. 4, the first or larger stripper means is provided with a circumferentially extending outwardly directed dovetailed projection 24 which is compressed into sealing engagement with a complementary shaped annular circumferentially extending groove formed between the illustrated component parts.

A series of radially spaced countersunk fastener means 27 are arranged along a bolt circle and provide means by which the stripper can be removably affixed to the rotating skirt. A small removable stripper assembly 29 is affixed to the larger underlying split plate assembly 39 by means of radially spaced bolts 30 set in a bolt circle, with bolts 30 being radially misaligned with respect to bolts 27. The small stripper 34 has a maximum i.d. 35 substantially smaller than the maximum i.d. of the large stripper.

The stripper plate assembly 37 compresses the illustrated outwardly directed flange of the stripper against the split rubber hold down plate 39.

A bowl clamp adapter ring assembly 40 is bolted onto the rotating sleeve in underlying aligned relationship respective to the outwardly directed shoulder 41 and in spaced relation respective of the outwardly directed shoulder 42 so that the two spaced circumferentially extending outwardly directed shoulders may be forced towards one another by means of the removable clamp member, generally illustrated by the arrow at numeral 43.

The circumferentially extending inwardly directed groove 44 of the clamp has an innermost wall portion spaced from members 41 and 42 so that the illustrated complementary wedge surfaces 53 and 54 of the stripper rubber and bowl adapter ring are forced into engagement as the split ring and clamp cooperate to force the members 41 and 42 towards one another with a tremendous force.

Retainer pin 45 pivotally secures the clamp assembly to the bowl clamp ring adapter, while hinge pin 46 is spaced outwardly therefrom and hingedly engages link 47 which connects together the two semi-circular halves of the clamp 48 and 49. Tension bolt 50 engages one of the swingable free ends of the two clamp halves so that the nut thereon can be torqued thereby bringing the free ends toward one another which in turn forces member 41 toward member 42 due to the wedge surface formed on the split ring and the clamp.

It will be noted that pin 45 connects the two clamp halves to the bowl clamp adapter ring so that the clamp halves can be swung away from one another in a pivotal manner about pin 45 when it is desired to remove the split ring and the stripper from the bowl. Lifting eye 52 facilitates lifting the entire BOP assembly for installation or transportation purposes.

Looking now to the lubrication supply system disclosed in FIG. 3, in conjunction with the details of FIG. 2, there is seen a positive displacement pump connected to a source of lubrication (not shown) thereby providing a pressurized lub supply at 55'. Conduit 55' is connected to passageway 56 which in turn communicates with the isolated chamber within which there is disposed the before mentioned seal of the hydraulic seal assembly.

Inwardly directed polished wall 57 terminates in a circumferentially extending upper groove 58, while polish wall 59 is a continuation of the before mentioned wash pipe or polished wall 22.

Seal 60 has a lower planar face which sealingly engages the upper shoulder 61 of the stationary sleeve member, with the last named shoulder being spaced from shoulder 62 of the rotating sleeve member. Seal 63 is a deformed chevron resilient member which sealingly engages opposed polished wall surfaces 57 and 59. The before mentioned retainer ring can be secured to the wash pipe if desired, however, such an expedient presents an additional wearing surface to the assembly.

Looking now to the details of FIGS. 6–10, there is seen illustrated therein the before mentioned rotatable sleeve member 12 having spaced axially aligned strippers 16 and 34 removably mounted therein in a manner similar to that disclosed in FIGS. 1–5. The upper stripper mount assembly 29 includes a bolt circle 30 formed thereon for attachment to the large stripper mounting means 39, which in turn is affixed to the rotating sleeve. A tool string 64 is made up of joints of drill pipe, for example, with the drill pipe having upset tool joints in the form of boxes and pins providing for the illustrated enlargement 65. The small stripper is sufficiently resilient to conform to the enlargement 65 as well as to the nominal drill pipe o.d.

Figure 11:
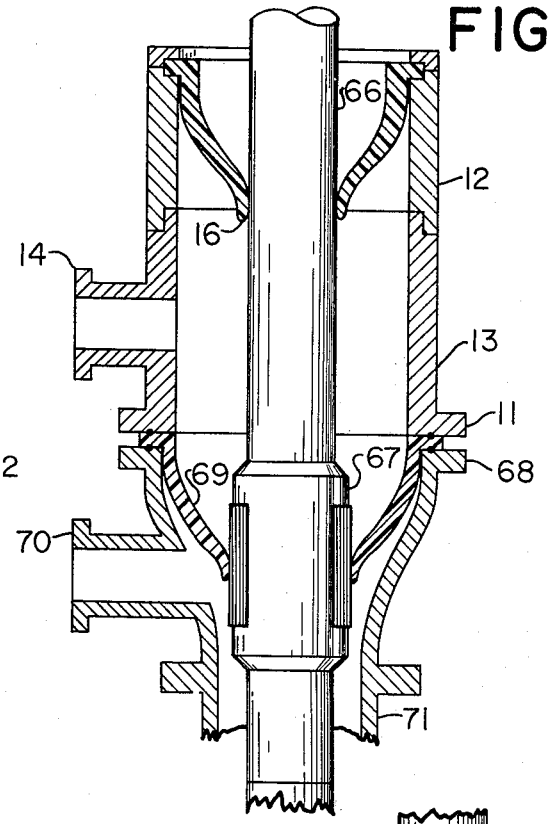
Figure 12:
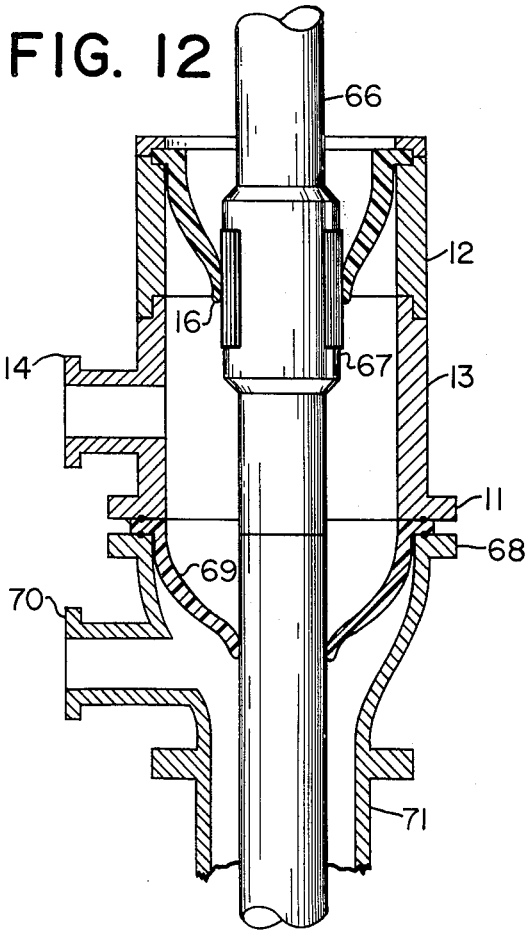
Figure 13:
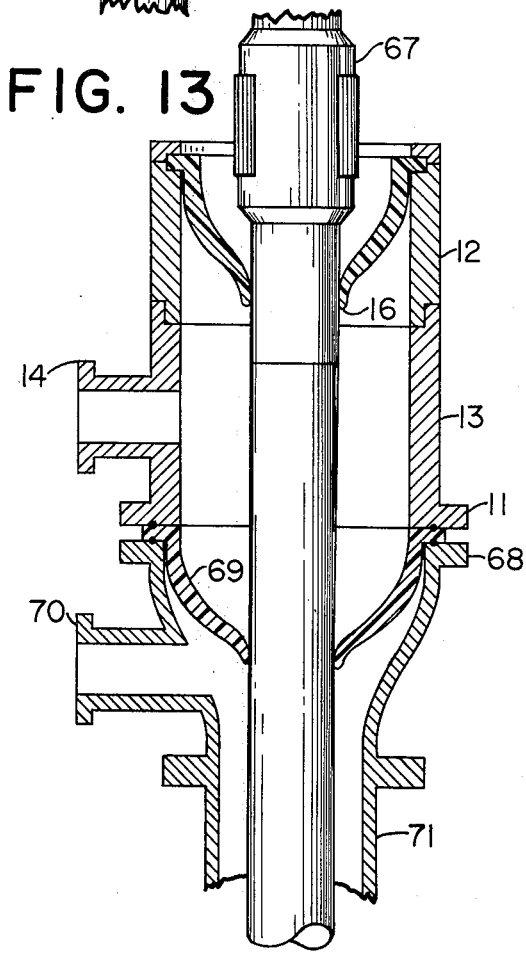

In FIGS. 11–13, the RBOP of the present invention is mounted to the upper extremity of a nonrotating BOP 68. A third and still lower stripper 69 is mounted to the upper terminal end portion of the nonrotating BOP in axial alignment with the stripper 16. Outlet 70 is flow connected to ambient, preferably the mud pit, with a valve (not shown) being interposed therein in the usual manner. Numeral 71 indicates the upper end of the borehole casing of the upper end of a blind ram. The stripper 69 is equal in i.d. to the stripper 16. The smaller stripper 34 is not shown since it has already been removed from the rotating sleeve.

In operation, the RBOP of the present invention is bolted to the top of a well bore. Generally, it will be required that a blind ram be positioned in underlying relationship respective to the RBOP. Further, a nonrotating BOP 68 may be interposed between the RBOP and the blind ram. Sometimes still other well control devices may be series connected between the RBOP and the casing annulus.

The bowl clamp adapter ring 40 of the RBOP is affixed to the top of the rotating sleeve by the illustrated bolts which are located in radially spaced counterbores so that the bolts are fairly spaced from the coacting wedge surfaces 53, 54. The split rubber hold down plate usually will have previously been secured to the underlying metal flange of the stripper by the countersunk fasteners 27.

The clamp 43 is next operatively positioned on the apparatus to force the hold down plate towards member 54 by bringing the free ends 48, 49 of the clamp towards one another as they pivot about support pin 45. The nut on bolt 50 is torqued to a proper value, thereby closing wedge interface 53 and 54 and compressing the dovetail annular gasket 24 within its annulus. The small stripper mount means is next positioned upon the large stripper mount means by making up fasteners 30. Where deemed desirable, a clamp similar to the arrangement disclosed at 43 can be used in lieu of or in conjunction with the flange 37 so as to enable the small stripper assembly to be rapidly removed from the large assembly in the same before described manner.

The lube pump is started, and a finite continuous flow of lubricant flows into chamber 57 with excess lubricant exiting under the resilient seal 60. Should a sudden increase in pressure be effected within the head, there can be no flow of debris into the seal assembly because of the force provided by the low volume positive displacement pump, the incompressibility characteristics of the lubricant, and the design of the seal 60. The seal acts as a one-way check valve with flow occurring into the rotating head but not vice versa.

In making hole, the head rotates with the drilling string being lowered into the well bore as may be required. During this time, the drill string is in the configuration of FIG. 6 with wear occurring only on small stripper 34. The only time wear is effected upon rubber 16 is when a stabilizer or drill collar is passed therethrough.

When it is necessary to make a trip out of the hole, in accordance with the embodiment of FIGS. 1–10, the drill pipe is withdrawn in the usual manner until the larger o.d. portion 66 of the string sealingly engages the large stripper. With the collar being positioned in the illustrated manner of FIG. 7, the small stripper assembly is removed from the large stripper mounting plate or hold down plate as diagrammatically illustrated in FIG. 8. The joint of drill pipe connected to the upper terminal end of the drill collar is removed, the small stripper assembly is removed from the drill pipe, leaving the drill collar held securely in the bowl of the turntable by conventional slips or the like, with the lower stripper controlling the well.

Figure 9:
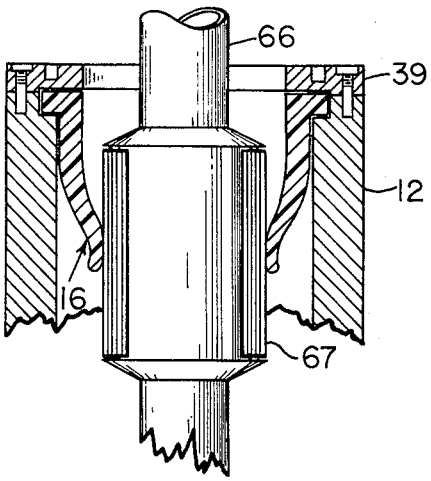

As seen in FIG. 9, the large stripper will deform sufficiently to conform to the contour of the stabilizer so as to enable it to be withdrawn from the borehole. In order to prevent channeling of well fluids through the rollers of the stabilizer, the blind ram or the hydril located below the RBOP is closed about the drill collar, thereby sealing off the annulus as the stabilizer is pulled through the stripper.

Figure 10:
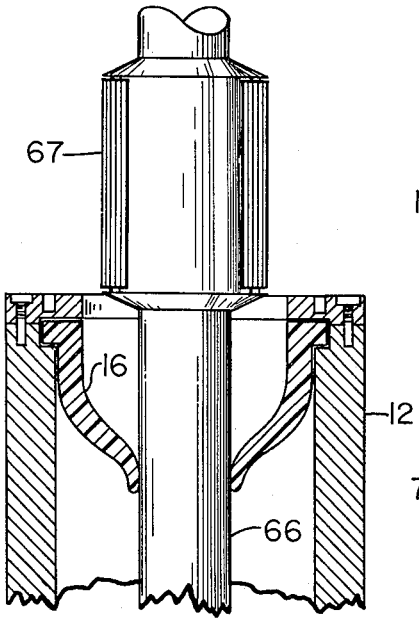

As seen in FIG. 10, the blind ram is opened and the drill collar is next moved up the borehole by raising the drill collar a maximum amount which will leave the stripper 16 engaged therewith, with the drill bit being located between the blind ram and the BOP. The blind ram is again closed, the drill collar and bit are moved in an upward direction until they clears the turntable, whereupon the entire drill string is now out of the hole and can be prepared for the next trip into the borehole. The blind ram is in control of the well during this part of the operation.

In the embodiment set forth in FIGS. 11-13, the drill pipe and uppermost stripper have already been removed from the assembly. The RBOp of the present invention is positioned above a fixed BOP 68 so that both the strippers 16 and 69 are in control of the well while an enlargement 67 is withdrawn from the borehole. This expedient enables circulation to be effected through either of outflow lines 14 and 70 as may be required for proper control of the well.

In FIG. 11, well fluid flows predominently through outlet 70, with a smaller flow occurring through the stabilizer and through the outlet 14, while stripper 16 controls the well. As seen in FIG. 12, after the stabilizer clears lowermost stripper 69 and is in the act of passing through the stripper 16, the well is controlled by the lowermost stripper 69. During this time, well fluid flows through outlet 70.

FIG. 13 shows the stabilizer clear of the RBOP with the lower outlet being in control of the well. The drill collar can be lifted into underlying relationship respective to either of the strippers, the blind ram closed, and the bit pulled through the rubbers.

Going back into the hole calls for a reversal of the various above procedures.

An important operative aspect of the invention lies in the split rubber hold down ring and its cooperative relationship with the clamp and stripper. This feature of the invention makes insitu replacement of the stripper possible by releasing the clamp and removing the split ring in an outward direction away from the string, and thereafter sliding the stripper up the string and through the rotary table, it being noted that the hold down plate is too large to be brought through the table. Hence, it is unnecessary to come out of the hole or to remove the RBOP in order to replace the stripper. Further, the presence of bolts 27 is a convenience rather than a necessity.

Still another important operative feature of the invention lies in the external venting arrangement of the hydraulic seal. Should the hydraulic seal commence to leak, debris will be vented externally and cannot possibly contaminate the tapered roller bearings.

Further, advantage can be taken of the relative rotary motion effected between the fixed and rotating sleeves for driving a lube pump for each of the seal members. In particular, a pump affixed to the fixed sleeve structure can have its piston rod engaged with a lobe or cam located on the rotating sleeve so that a finite quantity of lubricant is supplied to the passageway 56 each revolution of the RBOP.

I claim:

1. Method of going into and coming out of a cased borehole with a tool string of varying outside diameter wherein the annulus formed between the tool string and the borehole wall near the casing head must be sealed against fluid flow, comprising the steps of:

1. sealing a first annulus near the casing head against fluid flow by sealingly engaging a relative small outside diameter of the tool string with a rotatable stripper rubber having a relative small inside diameter;
2. sealing a second annulus near the first annulus against fluid flow by sealingly engaging a relative larger outside diameter of the tool string with a rotatable stripper rubber having a relative larger inside diameter;
3. pulling the tool string from the borehole while a relative small outside diameter of the tool string engages the relative small inside diameter stripper rubber until a relative large outside diameter of the tool string sealingly engages the relative large inside diameter stripper rubber;
4. removing the small inside diameter stripper rubber from the casing head, while the relative larger inside diameter stripper rubber sealingly engages the relatively larger outside diameter of the tool string.

2. The method of claim 1 wherein the smaller inside diameter stripper rubber is renewed following step (4).

3. Method of going into and coming out of a cased borehole with a tool string of varying outside diameter wherein the annulus formed between the toolstring and the casing wall near the casing head must be sealed against fluid flow, comprising the steps of:

sealing a first annulus near the casing head against fluid flow by sealingly engaging a relative small outside diameter of the toolstring with a rotatable stripper rubber having a relative small inside diameter;

sealing a second annulus near the first annulus against fluid flow by sealingly engaging a relative larger outside diameter of the toolstring with a rotatable stripper rubber having a relative larger inside diameter;

reducing the pressure drop across one of the stripper rubbers by flowing fluid from the toolstring annulus located between the spaced stripper rubbers;

axially moving the toolstring into and out of the borehole while sealingly engaging a marginal circumferentially extending length of the toolstring with at least one of the recited stripper rubbers.

4. The method of claim 3 and further including the steps of:

removably mounting the relative small inside diameter stripper rubber in spaced and fixed relation respective to the relative large inside diameter stripper rubber;

rotatably mounting the relative large inside diameter stripper rubber to the casing head.

5. The method of claim 4 and further including the steps of:

reducing the pressure drop across one of the recited annulus by forming an outflow passageway in underlying relationship respective to the two recited stripper rubbers, so that fluid can flow from the lower borehole annulus.

6. The method of claim 3 and further including the steps of:

reducing the pressure drop across one of the recited annulus by forming an outflow passageway in underlying relationship respective to the two recited stripper rubbers, so that fluid can flow from the lower borehold annulus.

7. Method of controlling pressure within a borehole while going into and out of the borehole with a drill string of several different outside diameters along the length thereof, comprising the steps of:

attaching a first rotating blow-out preventer means to the upper extremity off the borehole;

removably attaching a second rotating blow-out preventer means to the upper extremity of the borehole with said first and second rotating blow-out preventer being spaced from and axially aligned with one another and the drill string;

making the first rotating blow-out preventer of a size to sealingly and slidably engage a relatively larger outside diameter marginal length of the drill string as compared to the second rotating blow-out preventer;

making the second rotating blow-out preventer of a size to sealingly and slidably engage a relatively small outside diameter marginal length of the drill string;

using the first blow-out preventer to sealingly engage a relatively larger outside diameter marginal length of the drill string while removing the smaller rotating blow-out preventer from the upper extremity of the borehole as the drill string is removed from the borehole to thereby enable a drill string of different diameters to be removed from the borehole.

8. The method of claim 7 and further including the steps of mounting the larger and smaller rotating blow-out preventer for rotation to the upper extremity of the borehole, and arranging the tubing string so that different outside diameters thereof simultaneously sealingly engage the smaller and larger blow-out preventer.

9. The method of claim 7 and further including the step of removably affixing the small blow-out preventer to the larger blow-out preventer and rotataby affixing the large blow-out preventer to the structure forming the borehole.

10. Method of controlling the pressure within a wellbore while going into and out of the wellbore with a drill string having different outside diameters along the length thereof comprising the steps of:

attaching a first rotating blow-out preventer means to the upper extremity of the wellbore so that the rotating blow-out preventer sealingly engages a marginal length of the drill string in a slidable manner;

removably attaching a second rotating blow-out preventer means to the upper extremity of the wellbore with said first and second rotating blow-out preventers being spaced from and axially aligned with one another and the drill string;

making the first rotating blow-out preventer of a size to sealingly and slidably engage a relatively larger outside diameter drill string as compared to the second rotating blow-out preventer;

using the second blow-out preventer to sealingly engage a relatively small outside diameter marginal length of the drill string;

using the first blow-out preventer to sealingly engage a relatively larger outside diameter marginal length of the drill string;

engaging the large outside diameter marginal length of the drill string with a fixed blow-out preventer substantially equal in size to the larger blow-out preventer after placing the fixed blow-out preventer in underlying relationship respective to the first blow-out preventer; and reducing the pressure within the annulus formed between the fixed and large blow-out preventer so that the fluid flowing through the fixed blow-out preventer can be directed away therefrom.

* * * * *

UNITED STATES PATENT OFFICE

CERTIFICATE OF CORRECTION

PATENT NO. : 3,965,987

DATED : June 29, 1976

INVENTOR(S) : Morris S. Biffle

It is certified that error appears in the above-identified patent and that said Letters Patent are hereby corrected as shown below:

Column 1, line 46, substitute --the-- for "of".

Column 2, line 37, substitute --then-- for "than".

Column 6, line 47, substitute --RBOP-- for "RBOp".

Column 8, line 38, correct spelling of "of".

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*